US011136637B2

(12) United States Patent
Lee et al.

(10) Patent No.: US 11,136,637 B2
(45) Date of Patent: Oct. 5, 2021

(54) WIRE ROD HAVING EXCELLENT LOW TEMPERATURE IMPACT TOUGHNESS AND MANUFACTURING METHOD THEREFOR

(71) Applicant: POSCO, Pohang-si (KR)

(72) Inventors: Hyong-Jik Lee, Pohang-si (KR); Young-Soo Chun, Pohang-si (KR)

(73) Assignee: POSCO, Pohang-si (KR)

( * ) Notice: Subject to any disclaimer, the term of this patent is extended or adjusted under 35 U.S.C. 154(b) by 463 days.

(21) Appl. No.: 15/772,495

(22) PCT Filed: Nov. 18, 2016

(86) PCT No.: PCT/KR2016/013365

§ 371 (c)(1),
(2) Date: Apr. 30, 2018

(87) PCT Pub. No.: WO2017/095049

PCT Pub. Date: Jun. 8, 2017

(65) Prior Publication Data

US 2019/0078174 A1 Mar. 14, 2019

(30) Foreign Application Priority Data

Dec. 4, 2015 (KR) ..... 10-2015-0172683

(51) Int. Cl.

| | |
|---|---|
| ***C21D 8/06*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |
| ***C22C 38/00*** | (2006.01) |
| ***C21D 9/52*** | (2006.01) |

(52) U.S. Cl.

CPC ..... *C21D 8/065* (2013.01); *C21D 8/06* (2013.01); *C21D 9/52* (2013.01); *C22C 38/001* (2013.01); *C22C 38/02* (2013.01); *C22C 38/04* (2013.01); *C22C 38/06* (2013.01); *C22C 38/16* (2013.01); *C21D 9/525* (2013.01); *C21D 2211/001* (2013.01)

(58) Field of Classification Search

None

See application file for complete search history.

(56) References Cited

U.S. PATENT DOCUMENTS

| | | | |
|---|---|---|---|
| 6,358,338 | B1 | 3/2002 | Guelton et al. |
| 8,926,772 | B2 | 1/2015 | Bouzekri et al. |
| 2009/0151824 | A1 | 6/2009 | Yamasaki et al. |
| 2015/0191805 | A1 | 7/2015 | Lee et al. |
| 2015/0354037 | A1 | 12/2015 | Lee et al. |

FOREIGN PATENT DOCUMENTS

| | | | | |
|---|---|---|---|---|
| CN | 101208445 | A | | 6/2008 |
| CN | 104704135 | A | | 6/2015 |
| CN | 104884661 | A | | 9/2015 |
| JP | 2001-49348 | A | | 2/2001 |
| JP | 2013-023743 | A | | 2/2013 |
| JP | 2013023743 | A | * | 2/2013 |
| KR | 10-1127532 | B1 | | 4/2012 |
| KR | 10-2012-0054941 | A | | 5/2012 |
| KR | 10-2012-0104021 | A | | 9/2012 |
| KR | 10-2014-0021165 | A | | 2/2014 |
| KR | 10-2014-0083795 | A | | 7/2014 |
| KR | 10-2015-0075336 | A | | 7/2015 |

OTHER PUBLICATIONS

Chinese Office Action dated Jul. 3, 2019 issued in Chinese Patent Application No. 201680070455.8.

* cited by examiner

*Primary Examiner* — Anthony M Liang

(74) *Attorney, Agent, or Firm* — Morgan, Lewis & Bockius LLP

(57) ABSTRACT

Disclosed are a steel wire rod having excellent low temperature impact toughness and a manufacturing method therefor. The steel wire rod having excellent low temperature impact toughness according to an embodiment of the present invention contains, by weight %, carbon (C): 0.40-0.90%, silicon (Si): 0.5-1.0%, manganese (Mn): 11-25%, copper (Cu): 1.0-3.0%, phosphorus (P): 0.020% or less, sulfur (S): 0.020% or less, aluminum (Al): 0.010-0.050%, nitrogen (N): 0.0010-0.0050%, and the remainder being Fe and unavoidable impurities. The steel wire rod has a microstructure which contains an austenite phase having an area fraction of 95% or more, and a volume fraction of a deformation twin formed in an austenite grain is 1-8%. Therefore, it is possible to provide a steel wire rod having excellent low temperature impact toughness used in industrial machines or automobile parts, etc.

9 Claims, No Drawings

WIRE ROD HAVING EXCELLENT LOW TEMPERATURE IMPACT TOUGHNESS AND MANUFACTURING METHOD THEREFOR

RELATED APPLICATIONS

This application is the U.S. National Phase under 35 U.S.C. § 371 of International Application No. PCT/KR2016/013365, filed on Nov. 18, 2016 which in turn claims the benefit of Korean Patent Application No. 10-2015-0172683 filed on Dec. 4, 2015, the disclosures of which applications are incorporated by reference herein.

TECHNICAL FIELD

The present disclosure relates to a wire rod having excellent low temperature impact toughness, used in an industrial machine, an automobile component, or the like, and to a method of manufacturing the same.

BACKGROUND ART

Recently, efforts to reduce carbon dioxide emissions, considered one of the main causes of environmental pollution, have become a global issue. In line with such efforts, active steps to regulate vehicle exhaust gas emissions have been undertaken. As a measure to comply with such regulations, automakers are attempting to reduce emissions through improvements in fuel efficiency. However, in order to improve fuel efficiency, weight reductions and higher degrees of performance are required in vehicles. Thus, the requirement for high strength in automobile materials and components formed thereof has increased. In addition, since demand for resistance to the shock of external impacts has also increased, impact toughness has also been recognized as an important material property of an automobile material or an automobile component.

A ferrite structure or a pearlite structure in a wire rod has a limitation in securing high strength and impact toughness. In general, materials having structures described above have characteristics in which impact toughness is relatively high, but strength is relatively low. In a case in which the materials are cold drawn to improve strength, high strength may be obtained. On the other hand, impact toughness may be drastically reduced in proportion to an increase in strength.

In general, a bainite structure or a tempered martensite structure may be used to simultaneously realize high strength and excellent impact toughness. However, even in this case, impact toughness is excellent at room temperature, but impact characteristics may be significantly degraded at a temperature lower than 0° C.

Since, in the case of a large number of industrial machines and automotive components, demand for high strength, as well as excellent impact toughness at a relatively low temperature, has constantly increased, there is great demand for the development of such wire rods.

DISCLOSURE

Technical Problem

An aspect of the present disclosure may provide a wire rod having high strength and excellent impact toughness even in a low-temperature environment and a method of manufacturing the same.

While exemplary embodiments have been shown and described above, it will be apparent to those skilled in the art that modifications and variations could be made without departing from the scope of the present invention as defined by the appended claims.

Technical Solution

According to an aspect of the present disclosure, a wire rod having excellent low temperature impact toughness comprises, by wt %, carbon (C): 0.40% to 0.90%, silicon (Si): 0.5% to 1.0%, manganese (Mn): 11% to 25%, copper (Cu): 1.0% to 3.0%, phosphorus (P): 0.020% or less, sulfur (S): 0.020% or less, aluminum (Al): 0.010% to 0.050%, nitrogen (N): 0.0010% to 0.0050%, iron (Fe) as a residual component thereof, and inevitable impurities, contents of C and Mn satisfying Relational Expression 1 below, wherein a microstructure includes an austenite phase in an area fraction of 95% or greater, and a deformation twin formed in the austenite grain is within a range of 1% to 8% in a volume fraction.

$$9<C\times Mn<11, \quad \text{[Relational Expression 1]}$$

where each of C and Mn is a content by weight of an element.

According to an aspect of the present disclosure, a method of manufacturing a wire rod having excellent low temperature impact toughness comprises providing a steel material satisfying a composition and Relational Expression 1; reheating the steel material; hot rolling the steel material; cooling the steel material; and cold drawing the steel material at an area reduction rate of 10% to 30%.

Advantageous Effects

According to an aspect of the present disclosure, a wire rod having high strength and low temperature impact toughness required in an industrial machine, as well as an automobile material or component, may be provided by adjusting stacking fault energy and a microstructure to reach a specific level.

Therefore, a steel material may be widely applied to a region to which high strength steel of the related art may not be applied, due to deterioration of low temperature impact toughness.

BEST MODE FOR INVENTION

Hereinafter, a wire rod of an exemplary embodiment will be described in detail.

First, the wire rod of an exemplary embodiment will be described in detail. The wire rod of an exemplary embodiment includes, by wt %, carbon (C): 0.40% to 0.90%, silicon (Si): 0.5% to 1.0%, manganese (Mn): 11% to 25%, copper (Cu): 1.0% to 3.0%, phosphorus (P): 0.020% or less, sulfur (S): 0.020% or less, aluminum (Al): 0.010% to 0.050%, nitrogen (N): 0.0010% to 0.0050%, iron (Fe) as a residual component thereof, and inevitable impurities.

Hereinafter, a steel component and a composition range of the wire rod of an exemplary embodiment will be described in detail (hereinafter, by wt %).

Carbon (C): 0.40% to 0.90%

C is an essential element to secure strength and is dissolved in steel to change stacking fault energy, thereby changing a deformation mode during cold working. In a case in which a C content is less than 0.40%, the stacking fault energy is so low that dislocation proliferation and formation of a deformation twin may not actively occur. Thus, target strength is difficult to obtain. In a case in which the C content exceeds 0.90%, an excessive C content may cause intergranular carbide to form during cooling, so that grain boundary embrittlement may be generated. Thus, ductility and impact toughness may be rapidly degraded. Therefore, in an exemplary embodiment, the C content may be within a range of 0.40% to 0.90%.

Silicon (Si): 0.5% to 1.0%

Si is an element effective in increasing strength through solid solution strengthening of a steel material, dislocation strengthening, and the formation of a deformation twin by being dissolved in austenite, when added to the steel material. In detail, the addition of Si causes stacking fault energy to be changed, thereby allowing dislocation proliferation and the formation of a deformation twin to be active. Thus, a strength improvement effect is significant. In a case in which the Si content is less than 0.5%, an addition effect thereof is insignificant. In a case in which the Si content exceeds 1.0%, strength is significantly increased, but ductility and impact toughness may be rapidly decreased. Therefore, in an exemplary embodiment, the Si content is within a range of 0.5% to 1.0%.

Manganese (Mn): 11% to 25%

Mn is an element dissolved in austenite to significantly stabilize an austenite phase and increasing the stacking fault energy to promote dislocation proliferation and the formation of the deformation twin. In a case in which the Mn content is less than 11%, the stacking fault energy is low, so that ε-martensite (epsilon martensite) may be generated during cold drawing or cold working. Thus, brittleness may occur. A case in which the Mn content exceeds 25% is not only economically disadvantageous, but also may cause a problem in which surface quality is degraded, since internal oxidation becomes significant during reheating for hot rolling. Therefore, in an exemplary embodiment, the Mn content is within a range of 11% to 25%.

Copper (Cu): 1.0% to 3.0%

Cu is one of the main elements stabilizing the austenite phase. Cu increases the stacking fault energy to make a significant contribution to dislocation proliferation and the formation of the deformation twin even during cold drawing. In addition, Cu is an element significantly increasing resistance to hydrogen delayed fracture, considered significant in high strength steel. In a case in which a Cu content is less than 1.0%, an addition effect thereof is difficult to expect. In a case in which the Cu content exceeds 3.0%, hot rolling properties may be degraded, thereby causing a surface defect. Therefore, in an exemplary embodiment, the Cu content is within a range of 1.0% to 3.0%.

Phosphorus (P): 0.020% or Less

P is a main cause of a reduction in toughness and delayed fracture resistance, due to being segregated at a grain boundary, and thus, it is preferable not to include P. Therefore, an upper limit thereof is limited to 0.020% in an exemplary embodiment.

Sulfur (S): 0.020% or Less

S is segregated at a grain boundary, reducing toughness and allowing a low melting point emulsion to form so as to inhibit hot rolling. Thus, it is preferable not to include S. Therefore, an upper limit thereof is limited to 0.020% in the present disclosure.

Aluminum (Al): 0.010% to 0.050%

Al is a powerful deoxidizing element, and allows oxygen to be removed from steel so as to improve cleanliness. In addition, Al is combined with nitrogen dissolved in steel to form aluminum nitride (AlN) and improves impact toughness through grain refinement. In a case in which an Al content is less than 0.010%, an addition effect thereof is difficult to expect. In a case in which the Al content exceeds 0.050%, a relatively large amount of alumina inclusions are generated, thereby significantly reducing mechanical properties. Therefore, in an exemplary embodiment, the Al content may be within a range of 0.010% to 0.050%.

Nitrogen (N): 0.0010% to 0.0050%

Nitrogen is an element able to change stacking fault energy and causing an increase in strength. In a case in which an N content is less than 0.0010%, an addition effect thereof is difficult to expect. In a case in which the N content exceeds 0.0050%, impact toughness may be adversely affected. Therefore, in an exemplary embodiment, the N content may be within a range of 0.0010% to 0.0050%.

In addition to a composition described above, a residual component thereof includes Fe and inevitable impurities. In an exemplary embodiment, an addition of other alloys in addition to an alloy composition described above is not excluded.

In the meantime, a wire rod of an exemplary embodiment may contain C and Mn such that C and Mn may satisfy Relational Expression 1 below, $$9<C\times Mn<11 \quad \text{[Relational Expression 1]}$$

Here, in Relational Expression 1, C and Mn are contents by weight of elements, respectively.

C and Mn increase stacking fault energy. Contents of C and Mn may be properly adjusted using a phenomenon in which stacking fault energy is reduced as a temperature is decreased, thereby adjusting stacking fault energy to be within a range of 20 $mJ/m^2$ to 25 $mJ/m^2$. In an exemplary embodiment, a high strength non-heat treated steel wire rod is provided using twinning induced plasticity (TWIP) at room temperature, while excellent impact toughness may be achieved through deformation induced martensitic transformation induced plasticity (TRIP) at a relatively low temperature.

In more detail, the wire rod of an exemplary embodiment may promote dislocation proliferation and the formation of the deformation twin through cold working at room temperature, so that a strain hardening rate may be significantly increased, and target high strength may be obtained. In addition, when the wire rod of an exemplary embodiment is used, in a case in which external strain or an impact is applied at a relatively low temperature, occurrence of martensitic transformation becomes easier, as compared with dislocation proliferation and the formation of the deformation twin, thereby significantly improving impact toughness.

The inventors have repeatedly conducted research and experiments based on a description provided above. As a result, the inventors have confirmed that a wire rod having an austenite structure having excellent low temperature impact toughness may be provided when a relationship between C and Mn, by wt %, satisfies $9<C\times Mn<11$, and proposed Relational Expression 1 above. In a case in which a value of $C\times Mn$ is 9 or lower, stacking fault energy is so low that TWIP may not appear during transformation at room temperature. In a case in which the value is 11 or higher, stacking fault energy is so high that a strength improvement effect due to twinning during transformation at room temperature may be exhibited, but it is difficult to secure an impact toughness improvement effect due to TRIP at a relatively low temperature.

Hereinafter, the microstructure of an exemplary embodiment will be described in detail.

In the wire rod of an exemplary embodiment, the microstructure may be formed of an austenite single phase. The wire rod may have a microstructure formed of an austenite phase in an area fraction of 100%. In consideration of an operating process, however, in order to achieve a technical effect of an exemplary embodiment, the wire rod may be formed of austenite in an area fraction of 95% or greater.

In a case in which ε-martensite or intergranular carbide is generated in steel, brittleness is likely to occur in a steel material. Thus, the structure may not be included therein, if possible. ε-martensite or intergranular carbide may be included in an area fraction of 5% or less, a range not impairing physical properties of the present disclosure. In order to prevent ε-martensite or intergranular carbide from being generated, in an exemplary embodiment, a cooling rate may be adjusted during cooling after the steel material is hot rolled, together with appropriate component control described below, thereby effectively achieving an objective described above.

In the meantime, in the wire rod of an exemplary embodiment, an austenite grain size may be 30 μm or less. In a case in which the austenite grain size exceeds 30 μm, the impact toughness improvement effect is insufficient. Thus, the austenite grain size is controlled to be 30 μm or less by controlling a hot rolling temperature and the cooling rate. In the meantime, in a case in which a cold drawing process is performed in a manufacturing method of an exemplary embodiment to be subsequently described, a grain is elongated in a length direction, but there is no significant change in an average grain size.

In addition, in the wire rod of an exemplary embodiment, the deformation twin may be formed in the austenite grain in a volume fraction of 1% to 8%. In a case in which the deformation twin is less than 1% in a volume fraction, target strength may not be secured. In a case in which the deformation twin exceeds 8%, strength thereof may exceed the target strength, and impact toughness may be drastically reduced.

A thickness of the deformation twin may be within a range of 15 nm to 35 nm, while interlamellar spacing of the twin may be within a range of 40 nm to 100 nm. In a case in which the thickness of the deformation twin is less than 15 nm, or the interlamellar spacing is less than 40 nm, strength thereof exceeds target strength, which is undesirable. Characteristics of the deformation twin may be effectively achieved by controlling a reduction rate during cold drawing to be 10% to 30%, as described hereinafter.

In addition, in an exemplary embodiment, the wire rod may be formed to have a <111> or a <100> fiber texture. Grains are rotated in <111> and <100> directions during cold drawing to allow the deformation twin to be easily formed, and the strain hardening rate is improved through active formation of the deformation twin, thereby obtaining the target strength.

Hereinafter, the manufacturing method of an exemplary embodiment will be described in detail. A method of manufacturing a wire rod of an exemplary embodiment includes providing a steel material satisfying a composition described above; reheating the steel material; hot rolling the steel material; cooling the steel material; and cold drawing the steel material.

First, the steel material satisfying a composition range described above is provided. Subsequently, the steel material is reheated. A range of a reheating temperature employed in an exemplary embodiment may be 950° C. to 1050° C. In a case in which the reheating temperature is lower than 950° C., a temperature of the steel material drops to be significantly low during hot rolling, thereby causing a surface defect. In a case in which the reheating temperature exceeds 1050° C., an austenite grain grows to be coarse, thereby degrading mechanical properties. Thus, the reheating temperature may be within a range of 950° C. to 1050° C.

Subsequently, the steel material having been reheated is hot rolled. A finish hot rolling temperature in the hot rolling may be controlled to be within a range of 750° C. to 850° C. In a case in which the finish hot rolling temperature is lower than 750° C., a surface defect of the steel material is likely to be generated. In a case in which the finish hot rolling temperature exceeds 850° C., a grain does not become fine, so that desired mechanical properties may not be obtained. Thus, the finish hot rolling temperature may be within a range of 750° C. to 850° C.

After finish hot rolling described above is performed, the steel material having been hot rolled is cooled. The cooling may be performed at a cooling rate of 1° C./s to 5° C./s in a section from a cooling initiation temperature to a cooling end temperature. In a case in which the cooling rate is lower than 1° C./s, intergranular carbide may be formed, thereby rapidly degrading ductility and impact toughness. In a case in which the cooling rate exceeds 5° C./s, a uniform microstructure is difficult to secure. Thus, the cooling rate may be within a range of 1° C./s to 5° C./s. The cooling initiation temperature is not specifically defined and refers to a temperature after the finish hot rolling. The cooling end temperature refers to a point at which cooling is finished when a temperature of the steel material reaches room temperature.

Cold working is performed to the steel material having been cooled. In the cold working, a die for cold drawing may be used. In this case, a cold reduction rate may be within a range of 10% to 30%. In a case in which the cold reduction rate is lower than 10%, strength to be implemented in an exemplary embodiment is difficult to secure. In a case in which the cold reduction rate exceeds 30%, strength thereof exceeds a range of required strength, and ductility is significantly decreased. Thus, the cold reduction rate may be within a range of 10% to 30%.

As described above, in order to secure target strength and low temperature impact toughness, in the wire rod of an exemplary embodiment, a deformation twin may be formed in a volume fraction of 1% to 8% in an austenite grain. A thickness of the deformation twin of the wire rod may be within a range of 15 nm to 35 nm, while interlamellar spacing of the deformation twin may be within a range of 40 nm to 100 nm. Descriptions above may be achieved by controlling the cold reduction rate during cold drawing.

The wire rod of an exemplary embodiment may secure tensile strength of 1400 MPa to 1600 MPa and an impact value of 100 J/cm$^2$ to 150 J/cm$^2$ even at room temperature and at −40° C.

INDUSTRIAL APPLICABILITY

Hereinafter, an exemplary embodiment will be described in detail. The exemplary embodiment described below is provided for the purpose of understanding the present disclosure, and should not be construed as limiting the disclosure thereto.

Exemplary Embodiment

After a molten steel having a composition component of Table 1 below was cast, and a steel material was obtained, the steel material was reheated at 1100° C., and the steel material was hot rolled. Final wire-rod rolling was performed at 800° C., and the steel material was cooled at a cooling rate described in Table 2 below, thereby manufacturing a wire rod having a diameter of 20 mm. An austenite grain size of each wire rod having been obtained was measured and is illustrated in Table 2.

Subsequently, after a cold drawing process is performed on a wire rod manufactured using a method described above, at a reduction rate in Table 2, tensile strength and an impact value were measured and are illustrated in Table 2.

In Table 2 below, austenite grain size was measured using an image analyzer, and a thickness of a deformation twin, lamellar spacing, and a volume fraction were measured using a transmission electron microscope (TEM) and an electron backscatter diffraction (EBSD) device. A crystal texture was also analyzed using the EBSD device. In addition, a room temperature tensile test was carried out for measurement, in which a crosshead speed was 0.9 mm/min to a yield point and was 6 mm/min thereafter to measure tensile strength and an elongation percentage. Furthermore, an impact test was carried out at room temperature and at −40° C. for measurement, using an impact tester in which curvature of an edge portion of a striker impacting a specimen was 2 mm and test capacity was 500 J.

As illustrated in Tables 1 and 2, a steel composition component is within a range of an exemplary embodiment and satisfies Relational Expression 1 ($9<C\times Mn<11$). It can be confirmed that, in the case of Inventive Examples 1 to 6 satisfying a manufacturing method of an exemplary embodiment, an austenite single phase structure is obtained, microstructural characteristics of a deformation twin are satisfied, and mechanical properties also represent tensile strength of 1400 MPa to 1600 MPa and an impact value of 100 J/cm$^2$ to 150 J/cm$^2$. The mechanical properties are obtained, since stacking fault energy is controlled to a specific level, thereby obtaining target strength with a relatively high level of strain hardening during cold drawing and absorbing impacts by martensitic transformation in the case of impacts at a relatively low temperature.

On the other hand, Comparative Examples 7 and 10 are cases in which contents of C and Mn were outside of a range of the present disclosure, respectively, and did not satisfy Relational Expression 1. Therefore, even when cold drawing is performed, dislocation proliferation and a formation of a deformation twin are not active, so that tensile strength may not reach target properties.

TABLE 1

| Classification | No. | Composition (wt %) C | Si | Mn | Cu | P | S | Al | N | Relational Expression 1 |
|---|---|---|---|---|---|---|---|---|---|---|
| Inventive Example | 1 | 0.40 | 0.7 | 23 | 2.3 | 0.017 | 0.019 | 0.029 | 0.0047 | 9.2 |
| | 2 | 0.49 | 0.5 | 20 | 1.6 | 0.014 | 0.016 | 0.015 | 0.0043 | 9.8 |
| | 3 | 0.60 | 0.6 | 18 | 2.1 | 0.016 | 0.013 | 0.018 | 0.0045 | 10.8 |
| | 4 | 0.71 | 0.5 | 14 | 1.4 | 0.015 | 0.014 | 0.034 | 0.0046 | 9.9 |
| | 5 | 0.82 | 0.8 | 13 | 2.7 | 0.013 | 0.010 | 0.041 | 0.0038 | 10.7 |
| | 6 | 0.88 | 0.9 | 11 | 2.5 | 0.015 | 0.014 | 0.023 | 0.0039 | 9.7 |
| Comparative Example | 7 | 0.32 | 0.6 | 26 | 1.5 | 0.011 | 0.009 | 0.018 | 0.0037 | 8.3 |
| | 8 | 1.20 | 0.9 | 17 | 2.2 | 0.014 | 0.014 | 0.019 | 0.0046 | 20.4 |
| | 9 | 0.53 | 1.8 | 19 | 2.0 | 0.013 | 0.010 | 0.027 | 0.0039 | 10.1 |
| | 10 | 0.72 | 0.7 | 9 | 0.3 | 0.017 | 0.014 | 0.036 | 0.0042 | 6.5 |
| | 11 | 0.80 | 0.5 | 15 | 3.4 | 0.017 | 0.017 | 0.017 | 0.0049 | 12.0 |
| | 12 | 0.89 | 0.8 | 12 | 1.8 | 0.013 | 0.012 | 0.022 | 0.0033 | 10.7 |
| | 13 | 0.57 | 0.7 | 19 | 2.0 | 0.015 | 0.014 | 0.023 | 0.0041 | 10.8 |
| | 14 | 0.45 | 0.5 | 22 | 2.1 | 0.012 | 0.017 | 0.025 | 0.0046 | 9.9 |
| | 15 | 0.61 | 0.6 | 17 | 1.8 | 0.016 | 0.015 | 0.018 | 0.0039 | 10.4 |

(In Table 1, Relational Expression 1 is C × Mn, and a residual component thereof is Fe and inevitable impurities.)

TABLE 2

| Classification | No. | Cooling rate (° C./s) | γ Grain Size (μm) | Cold Reduction Rate (%) | Twin Fraction (%) | Twin Thickness (nm) | Twin Interlamellar Spacing (nm) | Tensile Strength (MPa) | Elongation Percentage (%) | Impact Value (J/cm$^2$) Room Temperature | −40° C. |
|---|---|---|---|---|---|---|---|---|---|---|---|
| Inventive Example | 1 | 5 | 21 | 16 | 4 | 30 | 83 | 1405 | 15 | 141 | 143 |
| | 2 | 3 | 26 | 13 | 3 | 19 | 76 | 1430 | 13 | 129 | 132 |
| | 3 | 2 | 28 | 27 | 7 | 25 | 57 | 1470 | 12 | 121 | 125 |
| | 4 | 4 | 23 | 20 | 5 | 28 | 62 | 1525 | 11 | 113 | 114 |
| | 5 | 3 | 25 | 22 | 6 | 32 | 44 | 1562 | 11 | 109 | 108 |
| | 6 | 1 | 30 | 18 | 5 | 22 | 50 | 1591 | 10 | 102 | 103 |
| Comparative Example | 7 | 2 | 28 | 15 | 0.5 | 31 | — | 1070 | 18 | 160 | 135 |
| | 8 | 4 | 22 | 26 | 11 | 23 | 35 | 1684 | 8 | 87 | 33 |
| | 9 | 1 | 29 | 23 | 4 | 27 | 52 | 1559 | 9 | 85 | 32 |
| | 10 | 5 | 20 | 18 | 0.3 | 29 | — | 1138 | 17 | 153 | 126 |
| | 11 | 3 | 25 | 22 | 9 | 25 | 60 | 1573 | 11 | 110 | 46 |
| | 12 | 0.1 | 42 | 25 | 6 | 35 | 55 | 1586 | 5 | 64 | 24 |
| | 13 | 3 | 26 | 39 | 10 | 27 | 37 | 1652 | 8 | 84 | 30 |
| | 14 | 3 | 27 | 61 | 11 | 25 | 34 | 1822 | 7 | 67 | 21 |
| | 15 | 3 | 25 | 78 | 12 | 22 | 30 | 2035 | 5 | 32 | 10 |

(In Table 2, γ grain size is the austenite grain size.)

Comparative Example 8 is a case in which a C content is beyond the range of the present disclosure and outside of Relational Expression 1. Thus, the stacking fault energy is increased such that dislocation proliferation and the formation of the deformation twin are actively generated. Therefore, it can be confirmed that, due to rapid work hardening during cold drawing, tensile strength exceeds the target strength, but impact toughness is degraded.

Comparative Example 9 is a case in which Si is outside of the range of the present disclosure. It can be confirmed that Comparative Example 9 satisfies Relational Expression 1, but impact toughness is degraded due to a strengthening effect of Si.

In addition, Comparative Example 11 is a case in which the steel composition component satisfies the range of the present disclosure, but Relational Expression 1 does not satisfy the range of the present disclosure. It can be confirmed that sufficient strength may be secured due to work hardening during cold drawing, but martensitic phase transformation does not occur in the case of impacts at a relatively low temperature, thereby rapidly degrading impact toughness at a relatively low temperature.

Comparative Example 12 is a case in which the steel composition component and Relational Expression 1 satisfy the range of the present disclosure, but the austenite grain size becomes excessively large due to a significantly slow cooling rate in a manufacturing process. As a result, intergranular carbide was generated, thereby degrading impact toughness. Comparative Examples 13 to 15 are cases in which the steel composition component satisfies the range of the present disclosure and Relational Expression 1, and an amount of cold drawing exceeds 30%. Strength is rapidly increased, but ductility is decreased, thereby significantly degrading impact toughness.

While exemplary embodiments have been shown and described above, it will be apparent to those skilled in the art that modifications and variations could be made without departing from the scope of the present invention as defined by the appended claims.

The invention claimed is:

1. A wire rod comprising:

by wt %, carbon (C): 0.40% to 0.90%, silicon (Si): 0.5% to 1.0%, manganese (Mn): 11% to 25%, copper (Cu): 1.0% to 3.0%, phosphorus (P): 0.020% or less, sulfur (S): 0.020% or less, aluminum (Al): 0.010% to 0.050%, nitrogen (N): 0.0010% to 0.0050%, iron (Fe) as a residual component thereof, and inevitable impurities, contents of C and Mn satisfying Relational Expression 1:

$9<C\times Mn<11$, where C and Mn are contents by wt % of each element, wherein a microstructure includes an austenite phase in an area fraction of 95% or greater, and a deformation twin formed in an austenite grain is within a range of 1% to 8% in a volume fraction.

2. The wire rod of claim 1, wherein a size of the austenite grain is 30 μm or less.

3. The wire rod of claim 1, wherein a thickness of the deformation twin is 15 nm to 35 nm.

4. The wire rod of claim 1, wherein lamellar spacing of the deformation twin is 40 nm to 100 nm.

5. The wire rod of claim 1, further comprising a<111> or a<100> fiber texture.

6. A method of manufacturing the wire rod according to claim 1, comprising:

providing a steel material including, by wt %, carbon (C): 0.40% to 0.90%, silicon (Si): 0.5% to 1.0%, manganese (Mn): 11% to 25%, copper (Cu): 1.0% to 3.0%, phosphorus (P): 0.020% or less, sulfur (S): 0.020% or less, aluminum (Al): 0.010% to 0.050%, nitrogen (N): 0.0010% to 0.0050%, iron (Fe) as a residual component thereof, and inevitable impurities, in which contents of C and Mn satisfy Relational Expression 1:

$9<C\times Mn<11$, where C and Mn are contents by wt % of each element;

reheating the steel material;

hot rolling the steel material;

cooling the steel material; and cold drawing the steel material at an area reduction rate of 10% to 30%.

7. The method of claim 6, wherein the reheating is performed at a temperature of 950° C. to 1050° C.

8. The method of claim 6, wherein, in the hot rolling, finish hot rolling is performed at a temperature of 750° C. to 850° C.

9. The method of claim 6, wherein the cooling is performed at speed of 1° C./s to 5° C./s.

* * * * *